US005848786A

United States Patent [19]

Holland-Letz et al.

[11] Patent Number: 5,848,786

[45] Date of Patent: Dec. 15, 1998

[54] SHEET-EXTRACTING DEVICE WITH A CASSETTE FOR RECEIVING A STACK OF SHEETS

[75] Inventors: Günter Holland-Letz, Paderborn; Peter Weigel, Borchen; Waldemar Jäger, Paderborn, all of Germany

[73] Assignee: Siemens Nixdorf Informationssyteme Aktiengesellschaft, Paderborn, Germany

[21] Appl. No.: 704,689

[22] PCT Filed: Mar. 2, 1995

[86] PCT No.: PCT/DE95/00274

§ 371 Date: Sep. 16, 1996

§ 102(e) Date: Sep. 16, 1996

[87] PCT Pub. No.: WO95/25057

PCT Pub. Date: Sep. 21, 1995

[51] Int. Cl.[6] ..... B65H 7/08

[52] U.S. Cl. ..... 271/110; 271/126; 271/152

[58] Field of Search ..... 271/110, 111, 271/126, 153, 155, 156, 152, 265.01

[56] References Cited

U.S. PATENT DOCUMENTS

| | | | |
|---|---|---|---|
| 3,598,400 | 8/1971 | Nelson . | |
| 4,548,397 | 10/1985 | Runzi | 271/121 |
| 4,919,412 | 4/1990 | Weigel et al. | 271/110 |
| 5,104,109 | 4/1992 | Kubo | 271/3.1 |
| 5,207,416 | 5/1993 | Soler . | |
| 5,295,675 | 3/1994 | Hain | 271/12 |

FOREIGN PATENT DOCUMENTS

| | | |
|---|---|---|
| 3434780 | 3/1986 | Germany . |
| 36 07979 | 10/1986 | Germany . |
| 41 24 566 | 7/1992 | Germany . |
| 42 00 186 | 7/1993 | Germany . |
| 3706810 | 3/1998 | Germany . |
| 0070627 | 3/1990 | Japan . |
| 0127327 | 5/1990 | Japan . |
| 405051151 | 3/1993 | Japan . |
| 405201558 | 8/1993 | Japan . |

*Primary Examiner*—William E. Terrell
*Assistant Examiner*—Wonki Park
*Attorney, Agent, or Firm*—Hill & Simpson

[57] ABSTRACT

The invention relates to a sheet-extracting device with a cassette for receiving a stack of sheets, and to a method of controlling the pressing force of the stack of sheets against the extracting device. The latter has extracting rollers (16) which are arranged on a floating shaft (34). For its part, the floating shaft (34) is centrally connected in a rotationally fixed manner to a drive shaft (18) passing through it. The drive shaft (18) is mounted, by one end (20), in a frame-mounted bearing (21) and, by its other end (62), in a displaceable bearing (64). Acting on the bearing (64) is a force sensor (70, 74, 76) which is intended for determining the pressing force of the stack of sheets (12) against the extracting rollers (16). The pressing force is controlled such that it always moves within a narrow middle range between a minimum and a maximum possible value.

14 Claims, 3 Drawing Sheets

Figure 1:
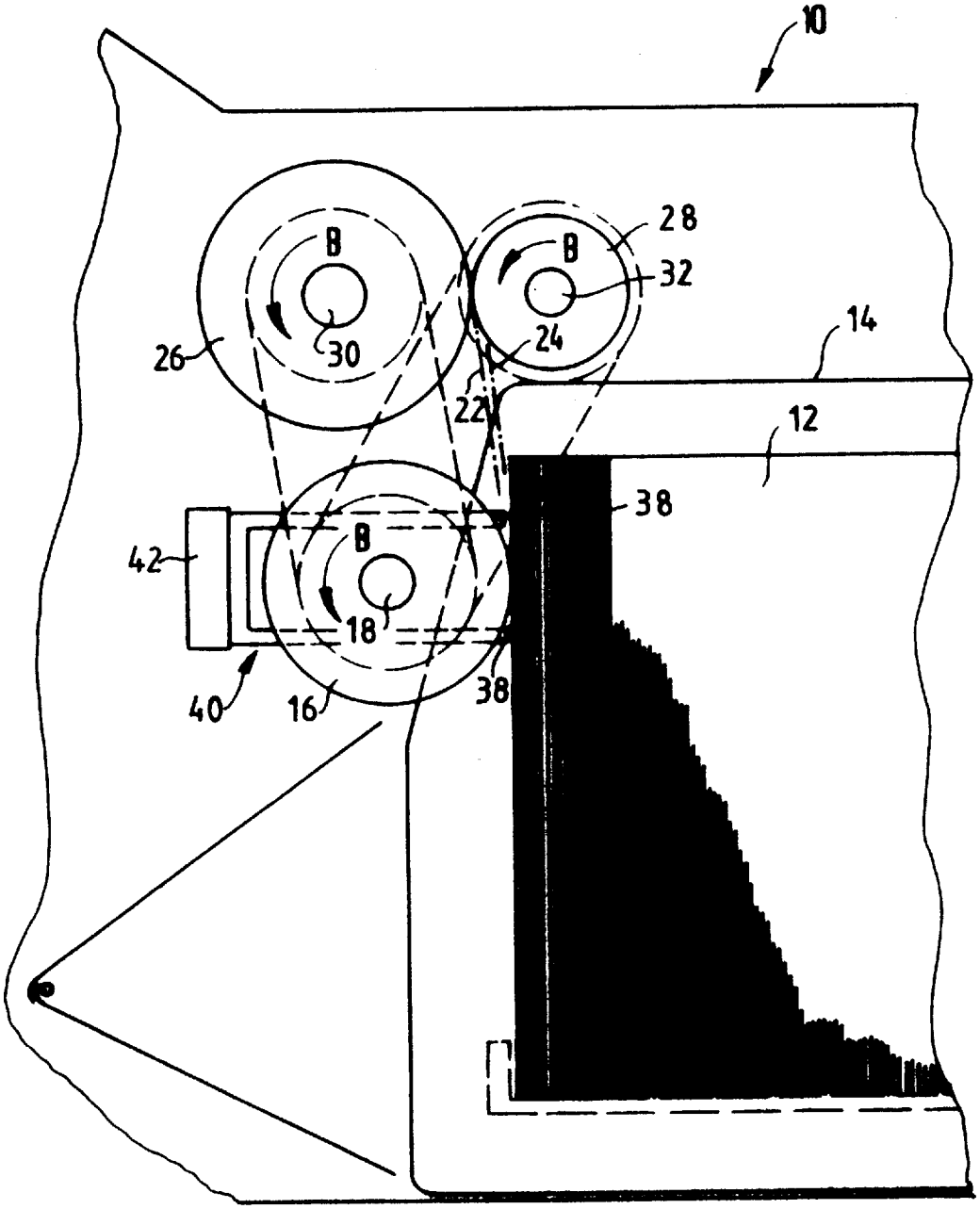

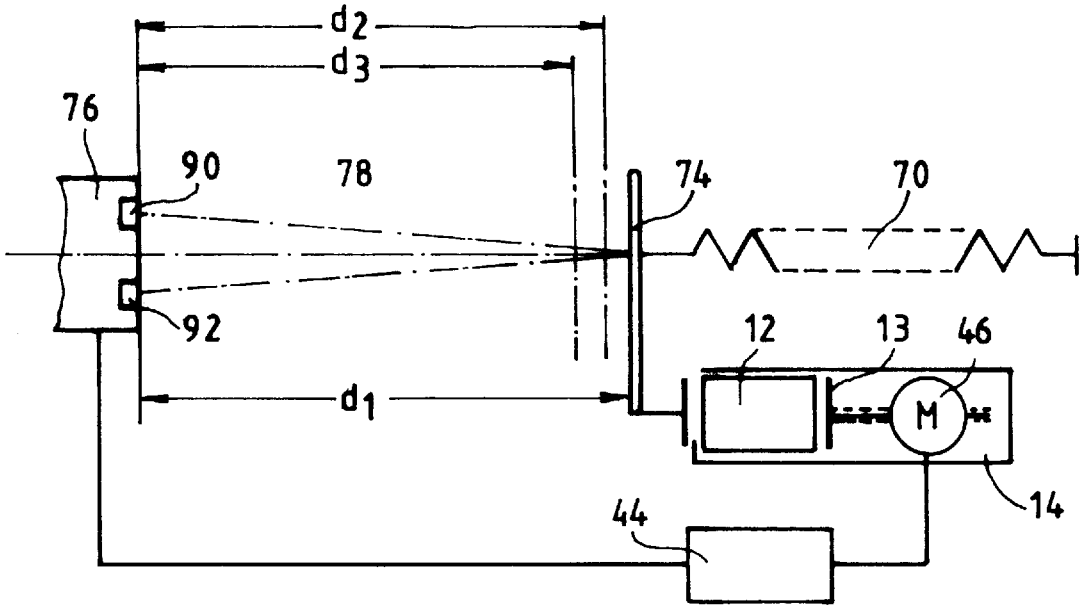
Fig. 3
Fig.4
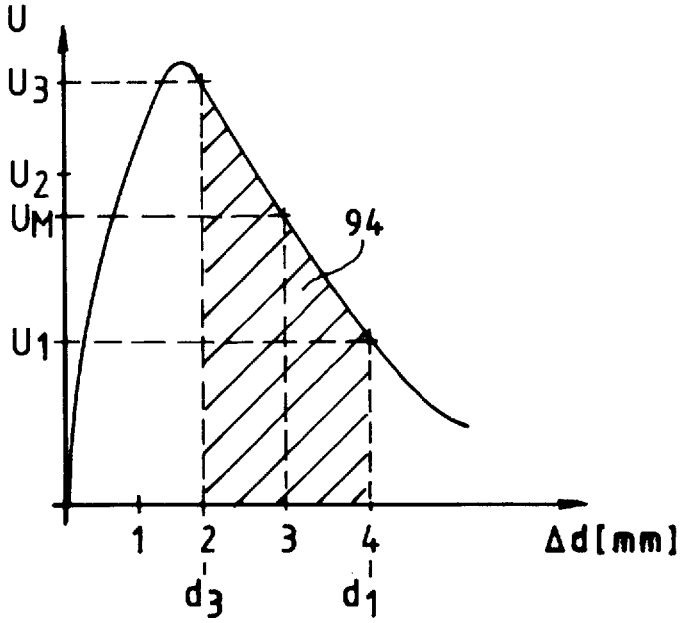

SHEET-EXTRACTING DEVICE WITH A CASSETTE FOR RECEIVING A STACK OF SHEETS

BACKGROUND OF THE INVENTION

The invention relates to a sheet-extracting device with a cassette for receiving a stack of sheets, and to a method of controlling the pressing force of the stack of sheets against the sheet-extracting device.

Cassettes of this type are used in sheet-extracting devices, in particular in automatic banknote dispensers. The pack of banknotes located in the cassette is pressed by a pressing element against an end wall of the cassette, which is designed such that the respectively forwardmost banknote is in contact with extracting elements reaching through the end wall. These extracting elements are normally extracting rollers, but may also be extracting fingers or the like.

It is already known to press the pack of banknotes by a sprung pressing plate against the extracting elements, the pressing plate triggering the control of a pressing slide by means of a displacement sensor. In this case, it is scarcely possible to ensure a constant pressing force, since the friction of the banknotes in the cassette changes with the number of banknotes in the pack and according to their condition (bends, folds and the like).

In the case of a known sheet-extracting device of the type mentioned as disclosed in DE 34 34 780 C2, the pack of banknotes is pressed against the extracting rollers by means of a pressing plate, which is displaced in the cassette by a motor. In that case, the pressing force of the extracting rollers against the forwardmost banknote is measured and used for controlling the drive motor. For that purpose, the spindle of the extracting rollers is mounted displaceably in the pressing direction on one side, it being supported directly against a force sensor. The bearing force measured by the force sensor is directly proportional to the pressing force of the stack of sheets on the extracting rollers.

However, the oblique position of the extracting shaft with respect to the stack of sheets, said position being caused by the yielding of the spindle on one side, creates the risk of extraction errors and of the banknotes skewing. This problem is heightened in that, in particular, stacks of banknotes are not of equal thickness over the entire surface of the stack. All the distortions, packing deformations, security-thread thickenings and gravure embossing on the note bundles result, in the case of large stacks, in changes in the stack thickness over the surface of the stack and thus also in unequal pressing forces on the extracting rollers. Compensation of these differences in thickness especially in the case of large filling quantities of, for example, more than one thousand banknotes in the cassette by virtue of a relatively high pressing force is not possible, or is possible only to an unsatisfactory extent. However, the extracting system as a whole only operates without disruption when the banknotes are extracted from the cassette in as straight and uniform a manner as possible.

SUMMARY OF THE INVENTION

The object of the present invention is to provide a sheet-extracting device with a cassette of the type mentioned at the beginning which ensures a uniform pressing force by simple means and in the case of which satisfactory extraction of the individual sheets from the stack is ensured even when the surface of the stack is not fully planar, and also to give a method by which the pressing force can be controlled.

This object is achieved by the present invention.

The invention is based on the finding that, in the case of a rotating extracting shaft with at least two extracting rollers, the only abutment of which is located between the extracting rollers and at the point of introduction of the torque, the entire pressing force acts on said abutment and can thus be measured there. This force is passed on to the drive shaft and can then also be measured in the bearings thereof. Since the ratio by which the pressing force is distributed to the bearings always remains the same, it is sufficient to measure the force at one end of the drive shaft. Guiding the floating shaft between legs of a guide fork which are directed perpendicularly with respect to the sheet plane ensures that it is only forces which are directed perpendicularly onto the surface of the forward-most sheet which take effect and are involved in the measurement. The floating shaft, which can be pivoted freely about its floating axis passing through the abutment, is not only adapted to unevenesses in the end face of the stack, but also ensures equal distribution of the extraction forces even in the case of unequal coefficients of friction on the extracting rollers.

Such an arrangement also tolerates the skewed position of a drive shaft which yields on one side, with the result that the problems arising in the prior art are eliminated. According to a development of the invention, the torque is introduced into the drive shaft on the fixedly mounted side. It is then only the bearing reaction forces which have to be absorbed. The other end of the drive shaft is mounted displaceably perpendicularly with respect to the sheet plane. The force sensor acts on said end.

The pressing force is determined by a spring which is coupled in a frictionally locking manner to the displaceable shaft end. The dislaceable pressing element pushes the stack of sheets against the extracting device and thus deflects the drive shaft. The spring is thus subjected to stressing and produces a reaction force which corresponds to the pressing force. The excursion displacement of the spring is thus a measure of the pressing force of the stack of sheets on the extracting device. A displacement sensor which detects the excursion displacement may then be used as force sensor.

The cassette can be fitted on the extracting device by pushing it on. In this case, the displacement sensor is designed such that it can also give out information on whether a cassette is pushed on or not. The displaceable shaft end is mounted in a displaceable bearing. This is moved into a first displacement position by the spring when the cassette has been removed. When the cassette is pushed onto the extracting device, it acts on the bearing and displaces it, counter to the spring forces, into a second position. This is indicated by the displacement sensor to a control means, which then, for its part, activates the pressing device, as a result of which the stack of sheets in the cassette is pushed against the extracting device, whose shaft yields as has been described and thereby increasingly subjects the spring to stressing until the displacement sensor signals an excursion displacement which corresponds to a predetermined pressing force. The pressing device is consequently switched off. The control method will be described further with reference to an exemplary embodiment.

According to a preferred embodiment, the displacement sensor comprises a reflection light barrier, the surface normal of a reflector which is fitted on the displaceable bearing being oriented in the displacement direction. In this arrangement, a mirror-surfaced planar reflector gives measuring results which can be reproduced particularly well.

The reflector is arranged at such a distance from the light barrier that the spot of light produced by the light transmitter is imaged with high definition on the light receiver and with approximately the magnitude of the light-sensitive surface area of the light receiver. The change in distance between light barrier and reflector associated with the displacement of the displaceable bearing causes, in the abovedescribed arrangement, a displacement-dependent change in the degree of illumination of the light-sensitive surface area. This results in a linear change, which is directly proportional to the displacement, in the output variable of the light receiver. The output variable serves to control the pressing motor.

Figure 2:
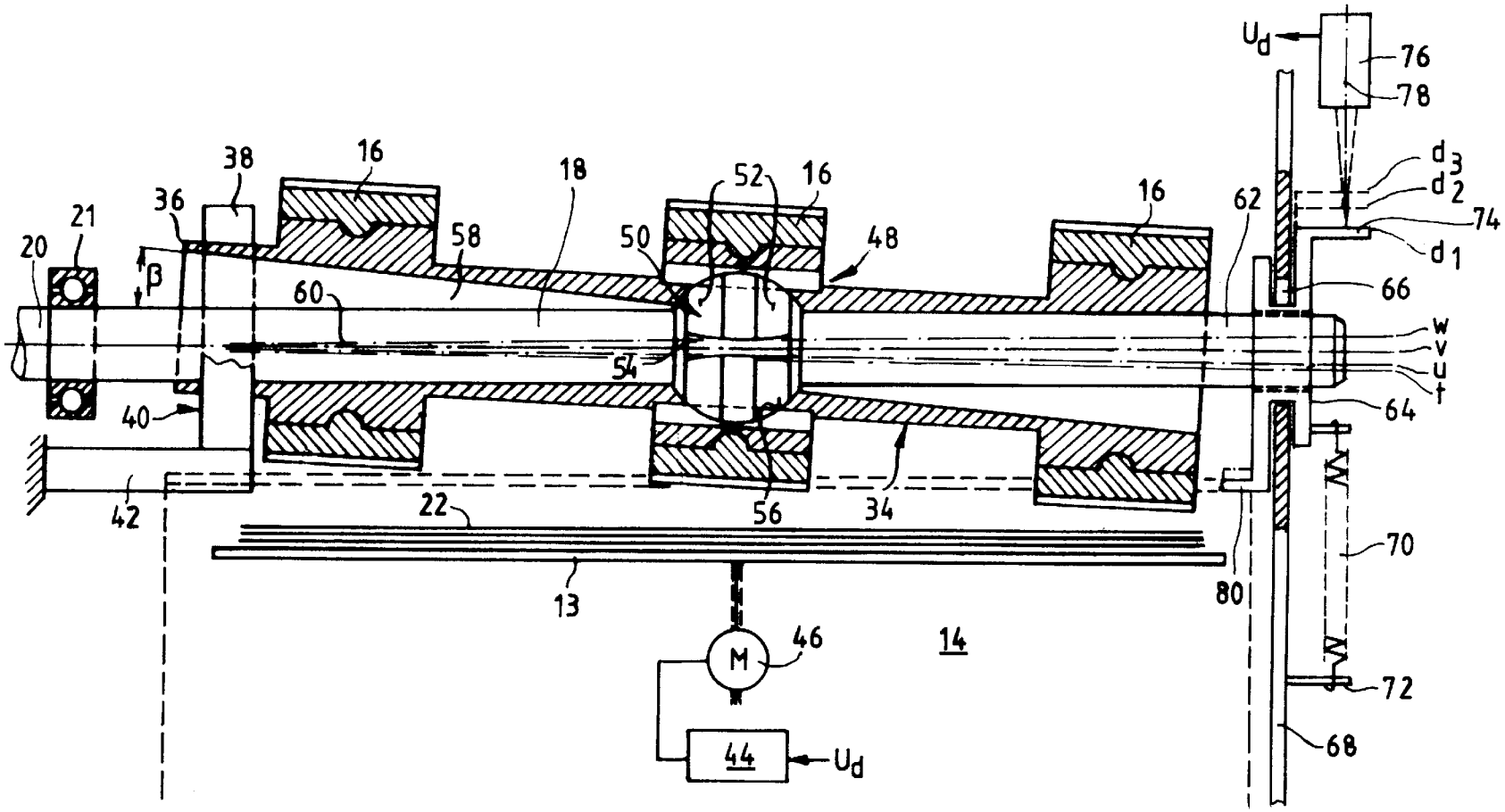

Further features and advantages of the invention may be gathered from the subclaims and the following description, which explains the invention with reference to an exemplary embodiment and in conjunction with the associated drawings, in which:

FIG. 1 shows a schematic partial side view of a storage container for banknotes and the basic elements of an extracting and separating device, FIG. 2 shows a plan view of an axis-containing section through the floating shaft with the drive shaft, FIG. 3 shows a schematic representation of an arrangement comprising pressing, force-measuring and control system, and FIG. 4 the characteristic curve of the force-measuring system in FIG. 3.

FIG. 1 shows part of a separating module which is designated in general terms by 10 and comprises a cuboidal frame into which a cassette 14 which contains a stack of sheets 12 is pushed. Extracting rollers 16 of an extracting device of the separating module 10 lie on the forwardmost sheet of the stack 12 contained in the cassette. The stack 12 is prestressed in the direction of the extracting rollers 16 by a pressing device 13 (FIG. 2) actuated by a pressing motor 46, with the result that the sheets of the stack 12 constantly butt against the extracting rollers 16 with a certain degree of prestressing. In a manner which will be explained in more detail at a later point in the text, the extracting rollers 16 are arranged on a drive shaft 18, one end 20 of which is mounted rotatably in a frame-mounted bearing 21 and can be driven in the direction of the arrow B.

The extracting rollers deliver that sheet 22 of the stack 12 which is butting against them in each case, or else, if appropriate, a number of sheets 22, 24 adhering to one another, in the direction of a nip between transporting rollers 26 and counteracting rollers 28 arranged on shafts 30 and 32, respectively, parallel to the drive shaft 18 and capable of being driven, in the same direction as the extracting rollers 16, in the direction of the arrow B. The task of the transporting rollers 26 is to deliver upward through the nip the sheet 22 butting against them, while the counteracting rollers 28 are intended to prevent more than one sheet from passing through the nip between the transporting rollers 26 and the counteracting rollers 28.

The extracting rollers 16 are arranged on a tubular floating shaft 34. Three extracting rollers 16 arranged at an axial spacing from one another are provided, the central extracting roller being located precisely in the center between the two outer extracting rollers.

The floating shaft 34 is mounted on the drive shaft 18 by means of a universal joint, which is designated in general terms by 48. The universal joint comprises a bearing ball 50 which is connected fixedly to the drive shaft 18 and has annular bearing surfaces 52. In the present example, two axis-parallel grooves 54 are made in the surface of the bearing ball 50, only one of these grooves being visible in FIG. 2.

Bearing surfaces 56 in the form of ball sockets are made in the floating shaft 34 in the region of the central extracting roller 16, precisely in the center between the two outer extracting rollers. Extending toward both ends of the floating shaft 34 from the bearing surfaces 56 are bores 58, the diameter of which widens conically toward the free ends of the floating shaft 34, with the result that it is possible for the floating shaft 34 to be pivoted to either side by the angle $\beta/2$ from its central position directed parallel to the axis 60 of the drive shaft 18.

In order to permit a torque transmission from the drive shaft 18 to the floating shaft 34 while maintaining the capacity for pivoting of the same, pegs (not shown) which engage into the grooves 54 in the bearing ball 50 are provided in the region of the central extracting roller, on the inside of the floating shaft 34. This also means that, despite the torque transmission about the axis 60, a pivot movement of the floating shaft 34 about an axis perpendicular with respect to the plane of the drawing is possible.

Since, for equal distribution of the extraction forces, it is only a pivot movement of the floating shaft 34 perpendicular with respect to the plane of the sheet 22 to be extracted, i.e. perpendicular with respect to the stack end face, which is desired, the floating shaft 34 has, at its end which is on the left-hand side in FIG. 2, a guide extension 36 which engages between the two legs 38 of a guide fork 40 (FIG. 1) which prevents the floating shaft 34 from tilting about an axis perpendicular to the stack end face and permits only a floating movement of the floating shaft 34 about an axis parallel to the stack end face. The guide fork 40 is fastened on a carrier 42 which is connected rigidly to the frame of the separating module 10 and is indicated schematically in FIG. 1.

With the exception of the pressing motor 46, the arrangement which has been described thus far is known from German Patent Specification DE 41 24 566 C1.

The other end 62 of the drive shaft 18 is mounted in a displaceable bearing 64 which is designed as a sliding block and can slide smoothly in a slot 66 in the frame wall 68. A tension spring 70 acts on the bearing 64, and the other end of said tension spring is coupled, via a peg 72, to the frame wall 68. The spring 70 is arranged such that it pulls the displaceable end 62 of the drive shaft 18 in the direction of the cassette 14.

Fitted on that side of the displaceable bearing 64 which is remote from the cassette is a planar, mirror-surfaced reflector 74 whose surface normal is oriented in the displacement direction of the bearing 64. A reflection light barrier 76 is arranged opposite the reflector 74, its center line 78 being located perpendicularly on the reflector 74.

A carry-along member 80 which projects into the push-in path of the cassette 14 is integrally formed on the bearing 64.

The mode of operation of the sheet-extracting device according to the invention is explained hereinbelow with reference to FIG. 3, which shows a schematic representation of the pressing device 13, arranged in the cassette 14, with the pressing motor 46, of a control device 44, and of the measuring system which comprises the spring 70, the reflector 74 and the reflection light barrier 76 and is intended for measuring the pressing force. Reference is also made to FIG. 4, which shows the displacement path/output voltage characteristic curve of the abovementioned measuring system.

The focal distance of the optical system of the light barrier 76 and the spacing d between said light barrier and the reflector 74 are selected such that a spot of light produced by the light transmitter 90 is imaged with high definition in the plane of the light receiver 92 and with a magnitude which corresponds essentially to the light-sensitive surface area of the light receiver 92.

With the cassette 14 removed from the extracting system, the reflector 74 is spaced apart from the light barrier 76 by a distance $d_1$ which corresponds to an oblique position t of the drive shaft 18 (for reasons of clarity, FIG. 2 represents only those positions of the axis 60 of the drive shaft 18 which correspond to the various oblique positions t, u, v, w of said drive shaft 18). In this position, the light receiver 92 outputs a voltage $U_1$. This voltage is stored in a control means 44 as minimum value.

When the cassette 14 is pushed onto the extracting system, the cassette acts on the carry-along member 80, as a result of which the bearing 64, and with it the reflector 74, is displaced in the direction of the light barrier 76. In this position, the drive shaft assumes an oblique position u. The light-receiver voltage U rises to a value which lies in the bottom third of the operating range 94 of the light barrier 76. From the fact that the voltage U has assumed a value other than $U_1$, the control means 44 concludes that the cassette 14 is then located in an operating position from which sheets 22 can be extracted from the stack 12.

With control of the control device 44, the pressing device 13 is then displaced in the direction of the extracting device until voltage $U_3$at the top end of the operating range 94 has been set. The reflector 74 is then at a spacing $d_3$ from the light barrier 76 and the drive shaft has an oblique position w. From the values $U_1$ and $U_3$, the control means 44 calculates a mean operating value for the pressing force of the stack of sheets 12 against the extracting rollers 16, which, with an oblique position v of the drive shaft 18, results in a spacing $d_2$ between reflector 74 and light barrier 76. A voltage UM corresponds to this spacing.

By activating the pressing motor 46 in the backward direction, the control device 44 then reduces the pressing force to a value which corresponds to a voltage $U_2$ and is slightly above $U_M$. If sheets 22 are then extracted from the cassette 14, the pressing force decreases. As soon as the output voltage of the light receiver drops below the value $U_M$, the pressing force is increased again to a value corresponding to $U_2$. The difference between the values $U_2$ and $U_M$ corresponds to a predetermined number, preferably 10, of sheets 22 extracted from the stack 12.

The abovedescribed arrangement permits precise control of the pressing force of the stack of sheets 12 against the extracting rollers 16 with equal distribution of the extracting torque to all the extracting rollers. In this arrangement, the thickness of the stack of sheets is insignificant. The resolution of the measuring system for the pressing force is further increased in that the deflection of the reflector is increased by the length ratio of the lever arms, formed by the drive shaft 18, which are defined by the spacing between the bearings 21 and 64 and between the bearing 21 and the bearing ball 50.

When the cassette 14 is removed, the voltage drops back to the value $U_1$, whereupon the control device 44 emits a "cassette removed" status signal.

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications.

What is claimed is:

1. A device for dispensing sheets from a cassette for containing a stack of said sheets, the device comprising:

an extracting device including:

a plurality of extracting rollers for contacting a top sheet of the stack;

a tubular floating shaft on which the extracting rollers are mounted;

a drive shaft extending axially through the tubular floating shaft;

a universal joint mounting a central section of said tubular floating shaft to said drive shaft, so that the tubular floating shaft is generally radially pivotable but rotationally fixed relative to said drive shaft;

the tubular floating shaft being guideably disposed within a guide fork to be displaceable perpendicularly to a plane of said top sheet;

one end of the drive shaft being rotatably mounted in a bearing;

an opposite displaceable end of the drive shaft being mounted displaceably perpendicularly with respect to said plane;

a pressing device for pressing said stack with a pressing force against the extracting device;

a pressing motor for displacing the pressing device against the rear end side of the stack of sheets by a pressing motor;

a spring biased against the displaceable end of the drive shaft to determine the pressing force, the spring having an excursion displacement which is a measure of the pressing force;

a displacement sensor for measuring the excursion displacement of the spring;

wherein the cassette is removable from the sheet-extracting device and fittable thereon, the drive shaft having a first displacement position when the cassette is removed and a second displacement position when the cassette is fitted, the displacement sensor having a measuring range for detecting an absence or presence of the cassette, and, in the direction of spring excursion, the sensor having a further measuring range in which the displacement sensor measures the pressing force of the stack of sheets on the extracting device, the sensor emitting a signal to adjust the pressing motor depending the pressing force.

2. The device as claimed in claim 1, wherein the drive shaft is driven at the bearing-mounted end thereof.

3. The device as claimed in claim 1, wherein the force of the spring is proportional to the excursion displacement over at least part of its excursion.

4. The device as claimed in claim 1, wherein the displaceable end of the drive shaft is mounted in a displaceable bearing, and wherein the displacement sensor comprises a reflection light barrier and a reflector fitted on the displaceable bearing having a surface normally oriented in a displacement direction of the drive shaft.

5. The device as claimed in claim 4, wherein the reflector is planar and mirror-surfaced.

6. The device as claimed in claim 4, wherein the reflector is arranged at a distance from the reflection light barrier such that a spot of light produced by the light transmitter is imaged with high definition on the light receiver and with dimensions which correspond approximately to the light-sensitive surface area of the light receiver.

7. The device as claimed in claim 5, wherein displacement of the reflector causes a displacement-dependent change in a degree of illumination of the light receiver and thus in the output voltage thereof.

8. A sheet-extracting apparatus with a cassette for receiving a stack of sheets, said sheet-extracting device comprising:

an extracting apparatus having at least two extracting rollers for abutting against a top sheet which is to be extracted;

a pressing device that can press a front end side of said stack, with a pressing force against said extracting device;

a guide fork having a plurality of legs, said legs directed perpendicularly with respect to a plane of said sheets;

a drive shaft having a first end rotatably mounted in a frame-mounted bearing and a displaceable end opposite the first end of said drive shaft displaceably mounted perpendicularly with respect to said plane;

a universal joint;

a tubular floating shaft having a central section, said tubular floating shaft connected to said drive shaft in a rotationally fixed manner;

said rollers of said extracting device being arranged axially spaced from one another on said tubular floating shaft, the central section of said tubular floating shaft mounted with radial play on said drive shaft via said universal joint means, said drive shaft passing through said tubular floating shaft in a longitudinal direction, said tubular floating shaft adjustably guided between said plurality of legs of said guide fork;

a pressing motor that can displace said pressing device against the rear end of said stack;

a spring which acts on said displaceable end of said drive shaft, said pressing force determined by said spring, said spring having an excursion displacement which is a measure of said pressing force;

a displacement sensor for measuring said excursion displacement of said spring, said sensor located near the displaceable end of said drive shaft; and said cassette removable from said sheet-extracting device and fittable thereon, said drive shaft assuming a first displacement position when said cassette has been removed and a second displacement position when said cassette has been fitted to said sheet-extracting device, said displacement sensor having a measuring range, said measuring range determining an absence or a presence of said cassette, and in the direction of increasing excursion of said spring, said measuring range is adjoined by a further measuring range through which said displacement sensor measures said pressing force of said stack of sheets on said extracting device and emits a signal for readjusting said pressing motor, dependent on said pressing force.

9. The apparatus as claimed in claim 8, wherein a torque is introduced into said drive shaft at said first end thereof.

10. The apparatus as claimed in claim 8, wherein said pressing force determined by said spring is proportional to said excursion displacement at least over part of said excursion displacement of said spring.

11. The apparatus as claimed in claim 8, wherein said displaceable end of said drive shaft is mounted in a displaceable bearing, and wherein said displacement sensor comprises a reflection light barrier and a reflector, said reflector fitted on said displaceable bearing and having a surface normally oriented in a displacement direction of said drive shaft.

12. The apparatus as claimed in claim 11, wherein said reflector is planar and mirror-surfaced.

13. The apparatus as claimed in claim 11, wherein said reflector is arranged at a distance from said reflection light barrier such that a spot of light produced by a light transmitter is imaged with high definition on a light receiver and with dimensions which correspond approximately to a light-sensitive surface area of said light receiver.

14. The apparatus as claimed in claim 13, wherein the displacement of said reflector causes a displacement-dependent change in a degree of illumination of said light receiver and thus in an output voltage thereof.

* * * * *